US008366342B2

(12) United States Patent
Sutchiewcharn et al.

(10) Patent No.: US 8,366,342 B2
(45) Date of Patent: Feb. 5, 2013

(54) SYSTEM FOR CONTINUOUS VEHICULAR TRAVEL ON CROSSING ROADWAYS

(75) Inventors: Narathip Sutchiewcharn, Niles, IL (US); Zongzhi Li, Clarendon Hills, IL (US); Jeffry Budiman, Lisle, IL (US); Jay Shen, Ames, IA (US)

(73) Assignee: The Galvin Project, Inc., Chicago, IL (US)

( * ) Notice: Subject to any disclaimer, the term of this patent is extended or adjusted under 35 U.S.C. 154(b) by 0 days.

(21) Appl. No.: 13/548,599

(22) Filed: Jul. 13, 2012

(65) Prior Publication Data

US 2012/0275856 A1 Nov. 1, 2012

Related U.S. Application Data

(63) Continuation of application No. 13/366,753, filed on Feb. 6, 2012, now Pat. No. 8,221,023, which is a continuation of application No. 12/612,083, filed on Nov. 4, 2009, now Pat. No. 8,109,690.

(60) Provisional application No. 61/198,264, filed on Nov. 4, 2008.

(51) Int. Cl.
*E01D 21/00* (2006.01)
*E01C 1/04* (2006.01)

(52) U.S. Cl. ..... 404/1; 14/77.1

(58) Field of Classification Search ..... 404/1; 14/77.1
See application file for complete search history.

(56) References Cited

U.S. PATENT DOCUMENTS

| | | | | |
|---|---|---|---|---|
| 1,173,505 | A | 2/1916 | Hale | 404/1 |
| 2,941,454 | A | 6/1960 | Cedeno | 404/1 |
| 2,949,067 | A | 8/1960 | Cedeno | 404/1 |
| 3,238,854 | A | 3/1966 | Okubo | 404/1 |
| 3,386,351 | A | 6/1968 | Hara | 404/1 |
| 3,675,584 | A | 7/1972 | Hall | 104/28 |
| 4,592,673 | A | 6/1986 | Lee | 404/1 |
| 4,861,184 | A | 8/1989 | Mier | 404/1 |
| 4,927,288 | A | 5/1990 | Raswant | 404/1 |
| 5,049,000 | A | 9/1991 | Mier et al. | 404/1 |
| 5,154,533 | A | 10/1992 | Baldea | 404/1 |
| 5,520,478 | A | 5/1996 | Yin-Lung | 404/1 |
| 5,897,270 | A | 4/1999 | Barel | 404/1 |
| 6,685,386 | B1 | 2/2004 | Lee | 404/1 |
| 7,234,891 | B2 | 6/2007 | Niiya et al. | 404/1 |
| 7,425,104 | B2 | 9/2008 | Buteliauskas | 404/1 |
| 7,473,050 | B2 | 1/2009 | Liu et al. | 404/1 |
| 7,491,009 | B1 | 2/2009 | Remy | 404/1 |
| 2002/0036584 | A1 | 3/2002 | Jocoy et al. | 342/70 |
| 2008/0033631 | A1 | 2/2008 | Yin | 701/117 |
| 2008/0152426 | A1 | 6/2008 | Liu et al. | 404/1 |

*Primary Examiner* — Raymond W Addie
(74) *Attorney, Agent, or Firm* — Winston & Strawn LLP

(57) ABSTRACT

Systems and methods for improved vehicular movement between first and second crossing roadways. The systems employ multiple turn roadways to permit a vehicle traveling on one of the crossing roadways to appropriately turn and continuously travel onto the other of the crossing roadway. The systems are adaptable to use in conjunction with either left side of the road vehicle movement or right side of the road vehicle movement. In addition, the systems and methods can be adapted for use in conjunction a roadway crossing whereat at least one of the roads is for forwarded vehicle movement in only one direction.

19 Claims, 7 Drawing Sheets

SYSTEM FOR CONTINUOUS VEHICULAR TRAVEL ON CROSSING ROADWAYS

CROSS-REFERENCE TO RELATED APPLICATIONS

This application is a continuation of U.S. application Ser. No. 13/366,753 filed Feb. 6, 2012, now U.S. Pat. No. 8,221,023, which is a continuation of U.S. application Ser. No. 12/612,083 filed Nov. 4, 2009, now U.S. Pat. No. 8,109,690, which claims the benefit of U.S. provisional application No. 61/198,264 filed Nov. 4, 2008.

BACKGROUND

The invention relates generally to roadways for vehicular travel and, more particularly, for vehicular travel in a continuous fashion on crossing roadways.

Today, travel on various types or kinds of roadways via various types or kinds of vehicles is a common occurrence. For example, it is common to move or transport people, products and goods on roadways such as highways and byways in vehicles such as by car, bus and truck.

Unfortunately, roadway crossings such as in the form of intersections can present obstacles to desired vehicular movement on such roadways. In particular, roadway intersections can act to limit or hinder desired vehicular movement such as by reducing or limiting one or more of the speed, efficiency or safety of vehicle movement by or through a roadway crossing. For example, in addition to being a prime source for vehicle collisions, roadway intersections often result in delays in vehicle movement through the intersection and such as may undesirably increase vehicle exhaust emissions.

While particular highway designs, such as cloverleaf type interchanges, can facilitate vehicle movement at roadway crossings, cloverleaf type interchanges can require significant amounts of land or area for proper implementation. Consequently there is a need and a desire for roadway crossing systems that not only facilitate vehicle movement at roadway crossings but desirably do so in a relatively compact area such as to minimize the area of land required for proper implementation.

Thus, there is a need and a desire for improved vehicular movement at roadway crossings. In particular, there is a need and a desire for a roadway crossing system that better permits or facilitates vehicular travel in a continuous fashion on crossing roadways.

SUMMARY OF THE INVENTION

The invention now provides an improved system for continuous vehicular travel on crossing roadways and one which overcomes the previously mentioned problems.

The invention can be attained, at least in part, through a system for improved vehicular movement between first and second crossing roadways. In accordance with one embodiment such a system includes a first roadway for vehicular travel in at least a first roadway first direction. The system also includes a second roadway for vehicular travel in a second roadway first direction and in a second roadway second direction opposite the second roadway first direction. The first and second roadways are in a crossing alignment with the first roadway disposed at a distinct elevation relative to the second roadway in an area adjacent to the crossing.

The system further includes first, second, third and fourth turn roadways, with:

the first turn roadway connecting the first roadway with the second roadway and allowing a vehicle traveling on the first roadway in the first roadway first direction to continuously travel onto the second roadway in the second roadway first direction;

the second turn roadway connecting the first roadway with the second roadway and allowing a vehicle traveling on the first roadway in the first roadway first direction to continuously travel onto the second roadway in the second roadway second direction;

the third turn roadway connecting the second roadway with the first roadway and allowing a vehicle traveling on the second roadway in the second roadway first direction to continuously travel onto the first roadway in the first roadway first direction; and the fourth turn roadway connecting the second roadway with the first roadway and allowing a vehicle traveling on the second roadway in the second roadway second direction to continuously travel onto the first roadway in the first roadway first direction.

At least one of the second and third turn roadways traverses at least a portion of one of the first and second roadways.

The invention further comprehends a system for improved vehicular movement between a first roadway for multiple lane vehicular travel in both a first roadway first direction and in a first roadway second direction opposite the first roadway first direction and a second roadway for multiple lane vehicular travel in both a second roadway first direction and in a second roadway second direction opposite the second roadway first direction. The first and second roadways are in crossing alignment with the first roadway disposed at a distinct elevation relative to the second roadway in an area adjacent to the crossing.

A first turn roadway connects the first roadway with the second roadway and allows a vehicle traveling on the first roadway in the first roadway first direction to continuously travel onto the second roadway in the second roadway first direction. A second turn roadway connects the first roadway with the second roadway and allows a vehicle traveling on the first roadway in the first roadway first direction to continuously travel onto the second roadway in the second roadway second direction. A third turn roadway connects the second roadway with the first roadway and allows a vehicle traveling on the second roadway in the second roadway first direction to continuously travel onto the first roadway in the first roadway first direction. A fourth turn roadway connects the second roadway with the first roadway and allows a vehicle traveling on the second roadway in the second roadway second direction to continuously travel onto the first roadway in the first roadway first direction. A fifth turn roadway connects the first roadway with the second roadway and allows a vehicle traveling on the first roadway in the first roadway second direction to continuously travel onto the second roadway in the second roadway first direction. A sixth turn roadway connects the first roadway with the second roadway and allows a vehicle traveling on the first roadway in the first roadway second direction to continuously travel onto the second roadway in the second roadway second direction. A seventh turn roadway connects the second roadway with the first roadway and allows a vehicle traveling on the second roadway in the second roadway second direction to continuously travel onto the first roadway in the first roadway second direction. An eighth turn roadway connects the second roadway with the first roadway and allowing a vehicle traveling on the second roadway in the second roadway first direction to continuously travel onto the first roadway in the first roadway second direction. At least one of the second and third turn roadways traverses at least a portion of one of the first and second roadways.

The invention also relates to a method for improved vehicular movement between first and second crossing roadways, by providing a first turn roadway connecting the first roadway with the second roadway and allowing a vehicle traveling on the first roadway to continuously travel onto the second roadway in a first direction; providing a second turn roadway connecting the first roadway with the second roadway and allowing a vehicle traveling on the first roadway to continuously travel onto the second roadway in a second direction opposite the first direction; providing a third turn roadway connecting the second roadway with the first roadway and allowing a vehicle traveling on the second roadway to continuously travel onto the first roadway; and providing a fourth turn roadway connecting the second roadway with the first roadway and allowing a vehicle traveling on the second roadway in the second direction to continuously travel onto the first roadway. Advantageously, the second turn roadway and the third turn roadway each at least in part form a first multi-turn ramp that traverses the second roadway.

Other advantages will be apparent to those skilled in the art from the following detailed description taken in conjunction with the appended claims and drawings.

DETAILED DESCRIPTION OF THE INVENTION

Figure 1:
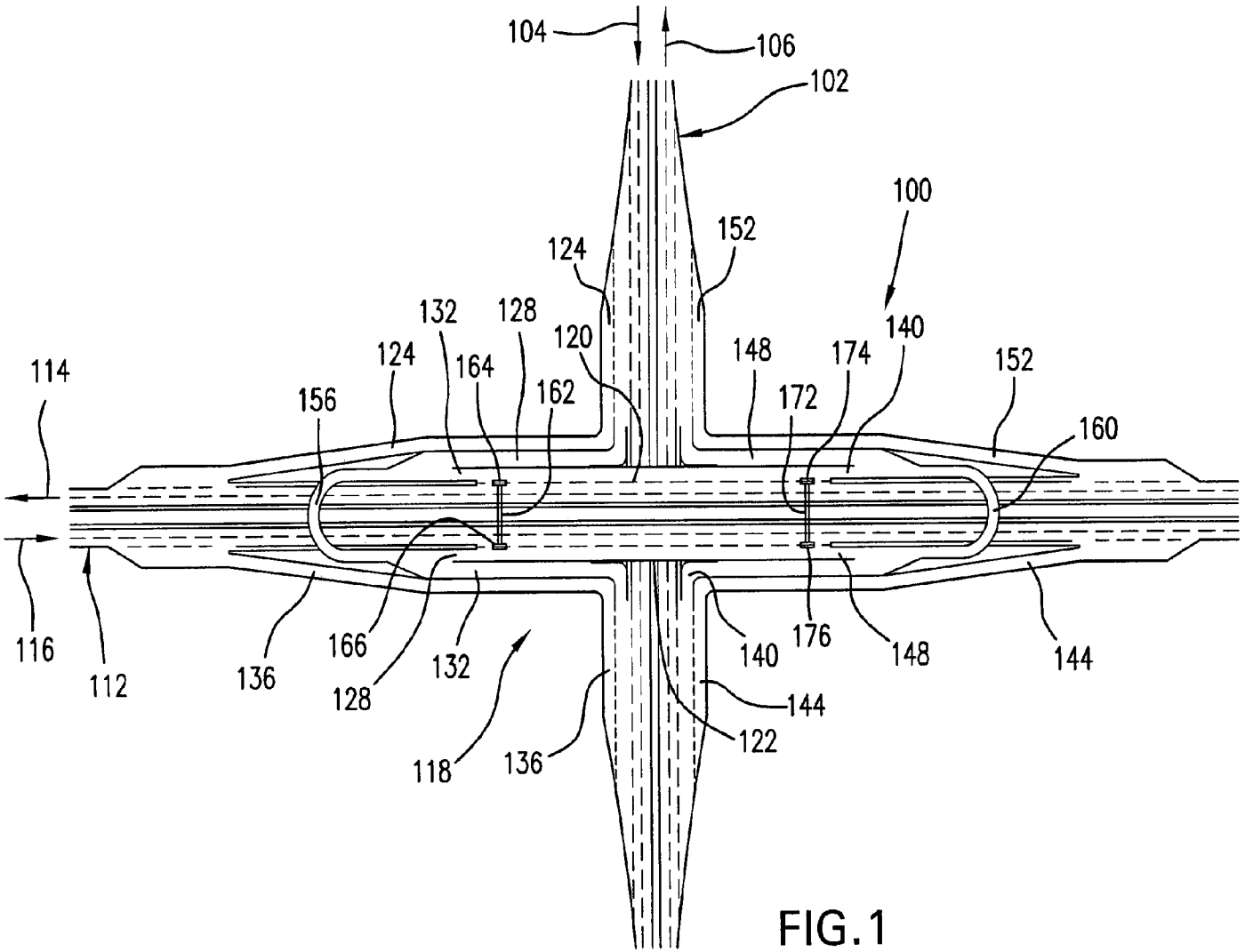
FIG. 1 is a top plan view schematic of a crossing roadway system in accordance with one preferred embodiment of the invention.
Figure 2:
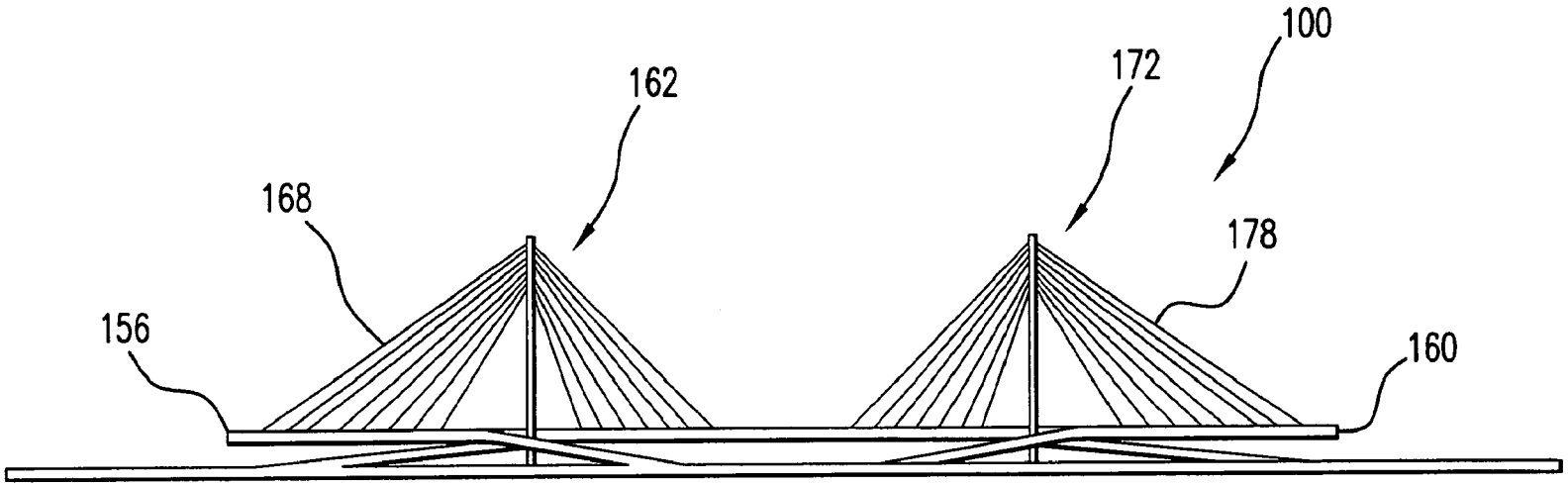
FIG. 2 is a side elevation view of the crossing roadway system shown in FIG. 1.

The present invention may be embodied in a variety of different roadway systems. As representative, turning to FIGS. 1 and 2, there is illustrated a crossing roadway system, generally designated by the reference numeral 100 in accordance with one preferred embodiment of the invention. The roadway system 100 includes a first roadway 102 such as for multiple lane vehicular travel in both a first roadway first direction (signified by the arrow 104) and in a first roadway second direction (signified by the arrow 106) opposite the first roadway first direction. The crossing roadway system 100 also includes a second roadway 112 such as for multiple lane vehicular travel in both a second roadway first direction (signified by the arrow 114) and in a second roadway second direction (signified by the arrow 116) opposite the second roadway first direction.

The first and second roadways 102 and 112 are in a crossing alignment with the first roadway 102 being disposed at a distinct elevation relative to the second roadway 112 in an area 118 adjacent to the crossing 120. For example, as shown, the second roadway 112 forms an overpass 122 over the first roadway 102.

The crossing roadway system 100 includes a first turn roadway 124 connecting the first roadway 102 with the second roadway 112 and allowing a vehicle traveling on the first roadway 102 in the first roadway first direction 104 to continuously travel onto the second roadway 112 in the second roadway first direction 114.

The crossing roadway system 100 also includes a second turn roadway 128 connecting the first roadway 102 with the second roadway 112 and allowing a vehicle traveling on the first roadway 102 in the first roadway first direction 104 to continuously travel onto the second roadway 112 in the second roadway second direction 116. As shown, the second turn roadway 128 connecting the first roadway 102 with the second roadway 112 crosses over or traverses at least a portion of the second roadway 112.

The crossing roadway system 100 further includes a third turn roadway 132 connecting the second roadway 112 with the first roadway 102 and allowing a vehicle traveling on the second roadway 112 in the second roadway first direction 114 to continuously travel onto the first roadway 102 in the first roadway first direction 104. As shown, the third turn roadway 132 connecting the second roadway 112 with the first roadway 102 crosses over or traverses at least a portion of the second roadway 112.

The crossing roadway system 100 still further includes a fourth turn roadway 136 connecting the second roadway 112 with the first roadway 102 and allowing a vehicle traveling on the second roadway 112 in the second roadway second direction 116 to continuously travel onto the first roadway 102 in the first roadway first direction 104.

The crossing roadway system 100 yet still further includes a fifth turn roadway 140 connecting the first roadway 102 with the second roadway 112 and allowing a vehicle traveling on the first roadway 102 in the first roadway second direction 106 to continuously travel onto the second roadway 112 in the second roadway first direction 114. As shown, the fifth turn roadway 140 connecting the first roadway 102 with the second roadway 112 crosses over or traverses at least a portion of the second roadway 112.

The crossing roadway system 100 also further includes a sixth turn roadway 144 connecting the first roadway 102 with the second roadway 112 and allowing a vehicle traveling on the first roadway 102 in the first roadway second direction 106 to continuously travel onto the second roadway 112 in the second roadway second direction 116.

The crossing roadway system 100 additionally includes a seventh turn roadway 148 connecting the second roadway 112 with the first roadway 102 and allowing a vehicle traveling on the second roadway 112 in the second roadway second direction 116 to continuously travel onto the first roadway 102 in the first roadway second direction 106. As shown, the seventh turn roadway 148 connecting the second roadway 112 with the first roadway 102 crosses over or traverses at least a portion of the second roadway 112.

The crossing roadway system 100 further additionally includes an eighth turn roadway 152 connecting the second roadway 112 with the first roadway 102 and allowing a vehicle traveling on the second roadway 112 in the second roadway first direction 114 to continuously travel onto the first roadway 102 in the first roadway second direction 106.

As shown, the second turn roadway 128 and the third turn roadway 132 can desirably each at least in part form a first multi-turn ramp, generally designated by the reference numeral 156. The first multi-turn ramp 156 traverses the second roadway 112.

Similarly, the fifth turn roadway 140 and the seventh turn roadway 148 can desirably each at least in part form a second multi-turn ramp, generally designated by the reference numeral 160. The second multi-turn ramp 160 also traverses the second roadway 112.

A first pylon support 162 supports the first multi-turn ramp 156 transverse the second roadway 112. The first pylon support 162 includes a pair of respective support members 164 and 166 and associated support cables or wires 168. The pylon support members 164 and 166 are generally parallel vertical members each disposed on an opposite side of the second roadway 112. As perhaps best seen by reference to one or more of FIGS. 3-8, such generally parallel vertical members can be further secured via the inclusion of one or more cross members 169 such as in the form of a generally horizontal member element as may join the generally vertical pylon support members 164 and 166.

Similarly, a second pylon support 172 supports the second multi-turn ramp 160 transverse the second roadway 112. The second pylon support 172 includes a pair of respective support members 174 and 176 and associated support cables or wires 178. The pylon support members 174 and 176 are generally parallel vertical members each disposed on an opposite side of the second roadway 112. As perhaps best seen by reference to one or more of FIGS. 3-8, such generally parallel vertical members can be further secured via the inclusion of one or more cross members 179 such as in the form of a generally horizontal member element as may join the generally vertical pylon support members 174 and 176.

As will be appreciated by those skilled in the art and guided by the teachings herein provided, such a system of support employing generally parallel vertical support members can significantly reduce or minimize right-of-way width requirements for implementation of the crossing roadway system herein described.

Such a crossing roadway system allows vehicles moving from any one direction to continue to flow and to turn right, to go straight, or to turn left through the roadway crossing, as may be desired. In particular, right turning vehicles can use designated right turn lanes in each approach. For a through movement vehicle, say along the first roadway 102, the vehicle can use the at-grade lanes under the overpass to flow through the roadway crossing. For a through movement vehicle passing along the second roadway 112, the vehicle can use the overpass to clear through the roadway crossing. For a left turning vehicle moving on either of the roadways and moving in either direction, the vehicle can use the appropriate elevated multi-turn ramp located between the through movement lanes and the right turn lanes to complete the left-turning movements and then merge with the through movement traffic after the turn in the respective direction.

To enhance an understanding and appreciation of advantages and benefits attendant the implementation of the subject crossing roadway system, reference is now made to FIGS. 3-8 which illustrate a vehicle (generally designated by the reference character "V") traveling through the system 100 at different selected points in the travel through the system.

Figure 3:
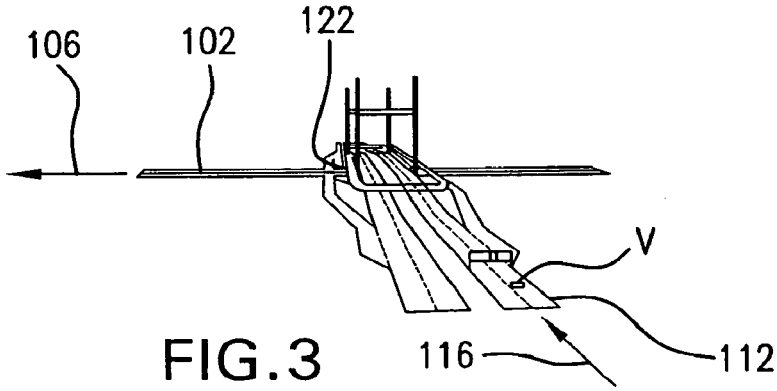
FIGS. 3-8 are perspective views of the crossing roadway system shown in FIGS. 1 and 2 and showing a vehicle traveling through the system at different selected points in the travel through the system.

FIG. 3 shows the vehicle V on the roadway 112 traveling in the direction 116 and wanting to turn onto roadway 102 to travel in the direction 106, as the vehicle V approaches the overpass 122.

Figure 4:
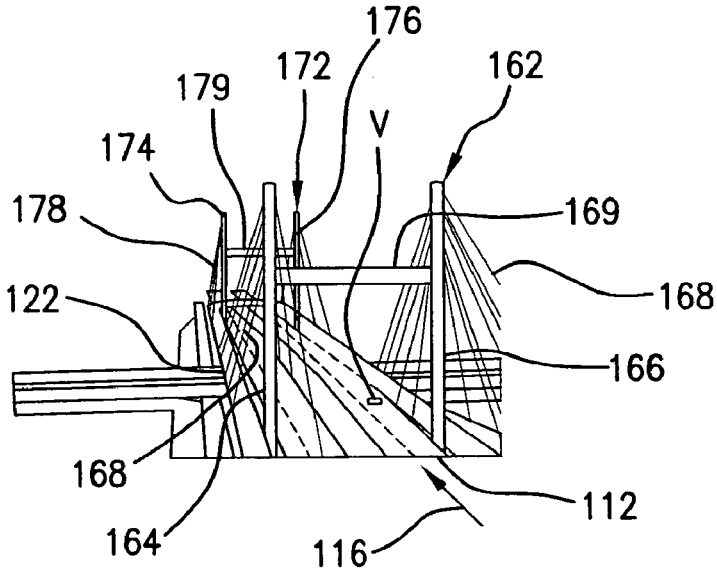

FIG. 4 shows the vehicle V still on the roadway 112 and traveling in the direction 116 but now on the overpass 122.

Figure 5:
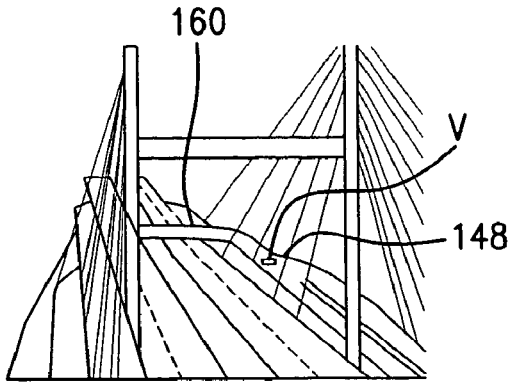

FIG. 5 shows the vehicle V continuing travel on the seventh turn roadway 148 and entering into the U-shaped portion of the multi-turn ramp 160.

Figure 6:
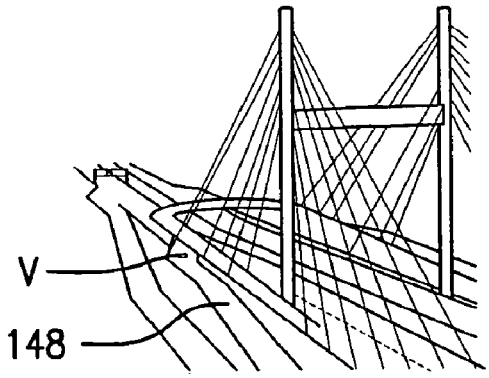

FIG. 6 shows the vehicle V continuing travel on the seventh turn roadway 148 here in the form of a ramp.

Figure 7:
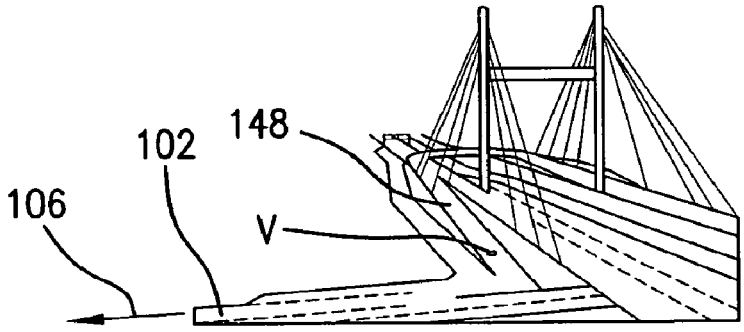

FIG. 7 shows the vehicle V continuing travel on the seventh turn roadway 148 approaching the roadway 102 for travel in the direction 106.

Figure 8:
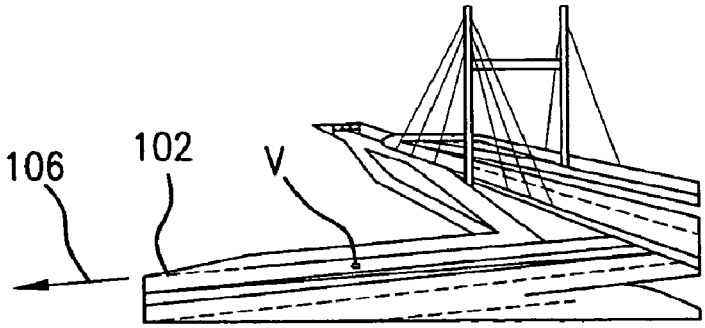

FIG. 8 shows the vehicle V having completed the left turn onto roadway 102 and traveling in the direction 106.

While the invention has been described above making specific reference to an embodiment wherein each of the respective crossing roadways permit travel in each of two opposed directions, those skilled in the art and guided by the teaching herein provided will appreciate that the broader practice of the invention is not necessarily so limited. For example, the invention can, if desired, be similarly applied to a roadway crossing wherein at least one of the crossing roadways is for vehicular travel in only one direction, i.e., a one-way road.

Figure 9:
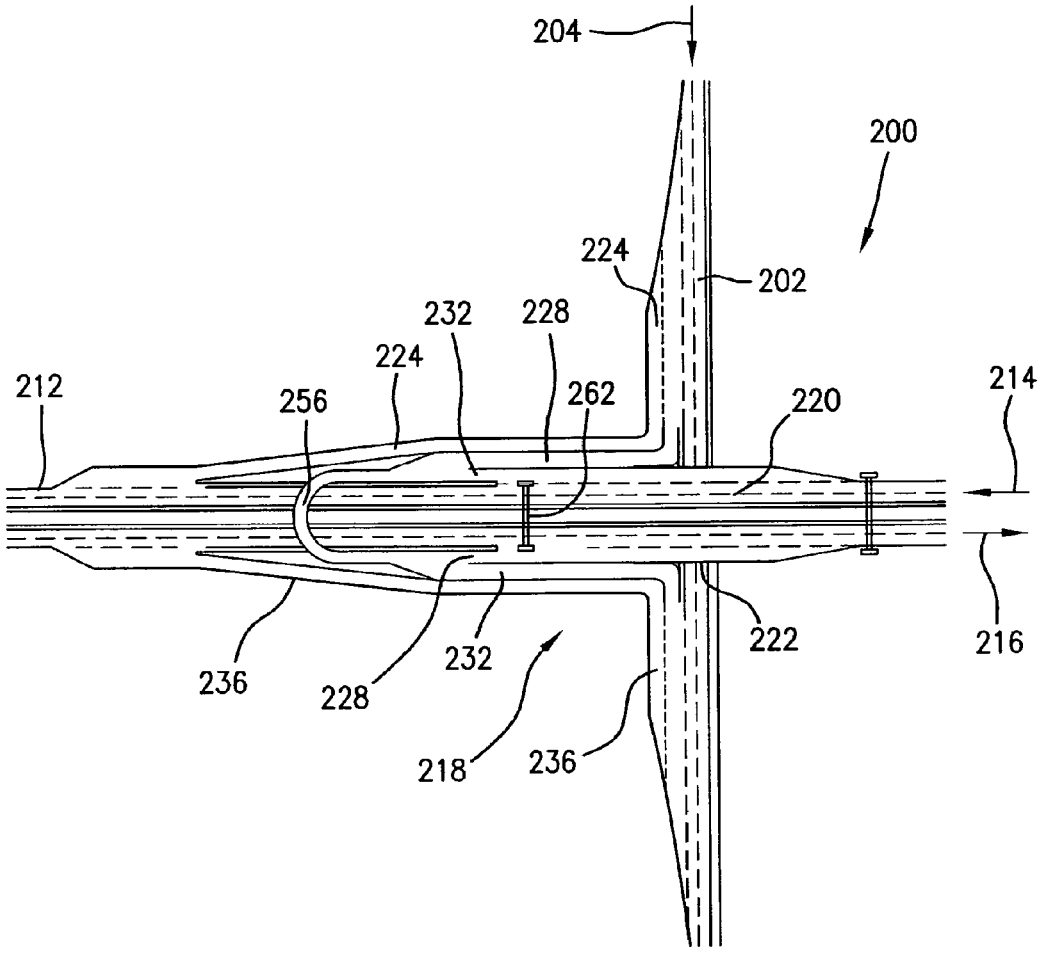
FIG. 9 is a top plan view schematic of a crossing roadway system in accordance with another embodiment.

FIG. 9 illustrates one such crossing roadway system, generally designated by the reference numeral 200.

The roadway system 200 includes a first roadway 202 such as for multiple lane vehicular travel in only a single first roadway direction (signified by the arrow 204). The crossing roadway system 200 also includes a second roadway 212 such as for multiple lane vehicular travel in both a second roadway first direction (signified by the arrow 214) and in a second roadway second direction (signified by the arrow 216) opposite the second roadway first direction.

The first and second roadways 202 and 212 are in a crossing alignment with the first roadway 202 being disposed at a distinct elevation relative to the second roadway 212 in an area 218 adjacent to the crossing 220. For example, as shown, the second roadway 212 forms an overpass 222 over the first roadway 202.

The crossing roadway system 200 includes a first turn roadway 224 connecting the first roadway 202 with the second roadway 212 and allowing a vehicle traveling on the first roadway 202 in the first roadway direction 204 to continuously travel onto the second roadway 212 in the second roadway first direction 214.

The crossing roadway system 200 also includes a second turn roadway 228 connecting the first roadway 202 with the second roadway 212 and allowing a vehicle traveling on the first roadway 202 in the first roadway direction 204 to continuously travel onto the second roadway 212 in the second roadway second direction 216. As shown, the second turn roadway 228 connecting the first roadway 202 with the second roadway 212 crosses over or traverses at least a portion of the second roadway 212.

The crossing roadway system 200 further includes a third turn roadway 232 connecting the second roadway 212 with the first roadway 202 and allowing a vehicle traveling on the second roadway 212 in the second roadway first direction 214 to continuously travel onto the first roadway 202 in the first roadway direction 204. As shown, the third turn roadway 232 connecting the second roadway 212 with the first roadway 202 crosses over or traverses at least a portion of the second roadway 212.

The crossing roadway system 200 still further includes a fourth turn roadway 236 connecting the second roadway 212 with the first roadway 202 and allowing a vehicle traveling on the second roadway 212 in the second roadway second direction 216 to continuously travel onto the first roadway 202 in the first roadway direction 204.

As shown, the second turn roadway 228 and the third turn roadway 232 can desirably each at least in part form a first multi-turn ramp, generally designated by the reference numeral 256. The first multi-turn ramp 256 traverses the second roadway 212.

A pylon support 262 supports the first multi-turn ramp 256 transverse the second roadway 212. The pylon support 262 may, if desired, be similar to the pylon support 162 described above in connection with the crossing roadway system 100 and such as including a pair of generally parallel vertical support members, each disposed on an opposite side of the second roadway 212, and with associated support cables or wires.

Moreover, while the invention has been described above making specific reference to roadways involving vehicular travel in a manner customary in the United States wherein forward movement of a vehicle occurs on the right hand side of the roadway, those skilled in the art and guided by the teaching herein provided will appreciate that the broader practice of the invention is not necessarily so limited. For example, if desired, the invention can be adapted for vehicular travel in a manner customary in the United Kingdom wherein forward movement of a vehicle occurs on the left hand side of the roadway.

Figure 10:
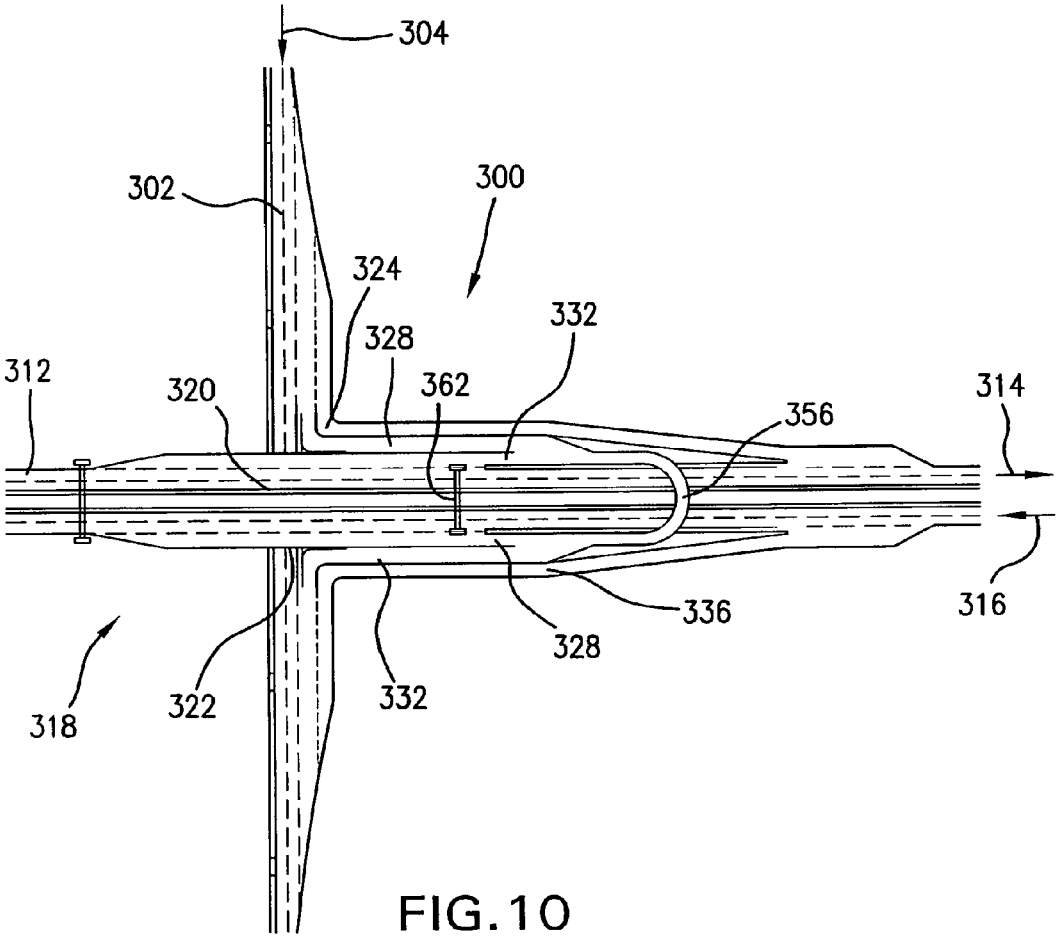
FIG. 10 is a top plan view schematic of a crossing roadway system in accordance with yet another embodiment.

FIG. 10 illustrates a crossing roadway system, generally designated by the reference numeral 300, generally similar to the crossing roadway system 200 shown in FIG. 9 and described above, but here employing a system of vehicular travel in a manner customary in the United Kingdom wherein forward movement of a vehicle occurs on the left hand side of the roadway.

The roadway system 300 includes a first roadway 302 such as for multiple lane vehicular travel in only a single first roadway direction (signified by the arrow 304). The crossing roadway system 300 also includes a second roadway 312 such as for multiple lane vehicular travel in both a second roadway first direction (signified by the arrow 314) and in a second roadway second direction (signified by the arrow 316) opposite the second roadway first direction.

The first and second roadways 302 and 312 are in a crossing alignment with the first roadway 302 being disposed at a distinct elevation relative to the second roadway 312 in an area 318 adjacent to the crossing 320. For example, as shown, the second roadway 312 forms an overpass 322 over the first roadway 302.

The crossing roadway system 300 includes a first turn roadway 324 connecting the first roadway 302 with the second roadway 312 and allowing a vehicle traveling on the first roadway 302 in the first roadway direction 304 to continuously travel onto the second roadway 312 in the second roadway first direction 314.

The crossing roadway system 300 also includes a second turn roadway 328 connecting the first roadway 302 with the second roadway 312 and allowing a vehicle traveling on the first roadway 302 in the first roadway direction 304 to continuously travel onto the second roadway 312 in the second roadway second direction 316. As shown, the second turn roadway 328 connecting the first roadway 302 with the second roadway 312 crosses over or traverses at least a portion of the second roadway 312.

The crossing roadway system 300 further includes a third turn roadway 332 connecting the second roadway 312 with the first roadway 302 and allowing a vehicle traveling on the second roadway 312 in the second roadway first direction 314 to continuously travel onto the first roadway 302 in the first roadway direction 304. As shown, the third turn roadway 332 connecting the second roadway 312 with the first roadway 302 crosses over or traverses at least a portion of the second roadway 312.

The crossing roadway system 300 still further includes a fourth turn roadway 336 connecting the second roadway 312 with the first roadway 302 and allowing a vehicle traveling on the second roadway 312 in the second roadway second direction 316 to continuously travel onto the first roadway 302 in the first roadway direction 304.

As shown, the second turn roadway 328 and the third turn roadway 332 can desirably each at least in part form a multi-turn ramp, generally designated by the reference numeral 356. The multi-turn ramp 356 traverses the second roadway 312.

A pylon support 362 supports the multi-turn ramp 356 transverse the second roadway 312. The pylon support 362 may, if desired, be similar to the pylon support 362 described above in connection with the crossing roadway system 300 and such as including a pair of generally parallel vertical support members, each disposed on an opposite side of the second roadway 312, and with associated support cables or wires.

While the invention has been described above making specific reference to a pylon system of roadway support such as involving a pair of generally parallel vertical support members, each disposed on an opposite side of the selected roadway, and with associated support cables or wires, those skilled in the art and guided by the teachings herein provided will appreciate that the broader practice of the invention is not necessarily so limited. For example, if desired, the invention can be practiced employing various other suitable means of roadway support such as known in the art. Furthermore, a roadway system of support employing a pylon-based support system can, if desired, suitably utilize support members having a shape or form other than vertical member.

Figures 11, 12:
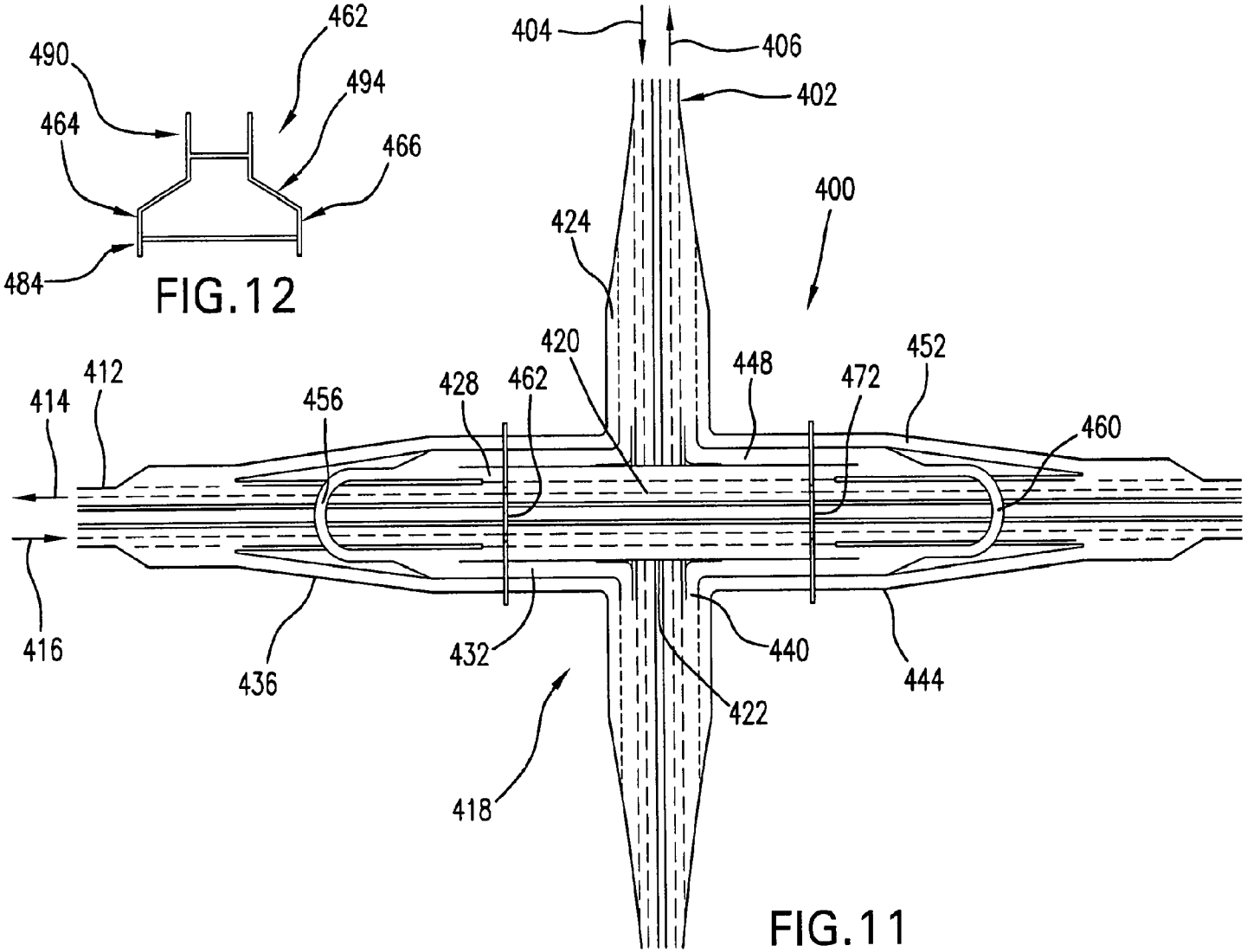
FIG. 11 is a top plan view schematic of a crossing roadway system in accordance with still another embodiment.
FIG. 12 is front view of a pylon support of the crossing roadway system shown in FIG. 11 with the pylon support shown in isolation.

For example, FIG. 11 illustrates a crossing roadway system, generally designated by the reference numeral 400, generally similar to the crossing roadway system 100 described above and such as including a first roadway 402 such as for multiple lane vehicular travel in both a first roadway first direction (signified by the arrow 404) and in a first roadway second direction (signified by the arrow 406) opposite the first roadway first direction. The crossing roadway system 400 also includes a second roadway 412 such as for multiple lane vehicular travel in both a second roadway first direction (signified by the arrow 414) and in a second roadway second direction (signified by the arrow 416) opposite the second roadway first direction.

The first and second roadways 402 and 412 are in a crossing alignment with the first roadway 402 being disposed at a distinct elevation relative to the second roadway 412 in an area 418 adjacent to the crossing 420 and such that second roadway 412 forms an overpass 422 over the first roadway 402.

The crossing roadway system 400 also includes first, second, third, fourth, fifth, sixth, seventh and eight turn roadways 424, 428, 432, 436, 440, 444, 448 and 452 generally similar to the corresponding turn roadways 124, 128, 132, 136, 140, 144, 148 and 152 described above and such as form first and second multi-turn ramps 456 and 460, similar to multi-turn ramps 156 and 160, described above. Moreover, a first pylon support 462 supports the first multi-turn ramp 456 transverse the second roadway 412 and a second pylon support 472 supports the second multi-turn ramp 460 transverse the second roadway 412.

The crossing roadway system 400 primarily differs from the crossing roadway system 100 described above in the structure or design of the support members forming the respective pylon support. Pylon support 462, as shown in FIG. 12, includes first and second horizontally spaced apart stepped support members 464 and 466 such as to be disposed on opposite sides of a respective roadway. The stepped support members 464 and 466 permit the formation of a pylon support 462 including a base portion 484 whereat the support members 464 and 466 are vertically arranged in parallel with a relative wide spacing therebetween, a top portion 490 whereat the support members 464 and 466 are vertically arranged in parallel with a relative narrow spacing therebetween and a central portion 494 whereat the support members 464 and 466 transition between the base portion 484 and the top portion 490.

The subject crossing roadway systems provide for vehicular movement between first and second crossing roadways, particularly in a continuous fashion and such as desirably results in one or more of improved or increased speed, efficiency and safety of vehicle movement. The invention desirably and advantageously minimizes and, preferably, eliminates the need for the presence or installation of traffic control devices, such as "YIELD" and/or "STOP" signs and signals, for example, at a subject roadway crossing. Moreover, such crossing roadway systems can desirably be implemented in a relatively compact area such as to reduce or minimize required land areas.

The subject crossing roadway systems can desirably be utilized for expressways, arterial highways and other high volume, low access roadways in urban and suburban areas to mitigate intersection-related traffic congestion and significantly reduce intersection-related crashes in the United States. In addition, the systems can be utilized in other countries such as experience significant intersection related traffic congestion, crashes, and vehicle air emissions.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method for improved vehicular movement between first and second roadways in crossing alignment, which method comprises:

providing the first roadway at a distinct elevation above the second roadway in an area where the roadways cross each other;

providing a first turn roadway connecting the first roadway with the second roadway and allowing a vehicle traveling on the first roadway in a first roadway first direction to continuously travel onto the second roadway in a second roadway first direction;

providing a second turn roadway connecting the first roadway with the second roadway and allowing a vehicle traveling on the first roadway in the first roadway first direction to continuously travel onto the second roadway in a second roadway second direction opposite the second roadway first direction;

providing a third turn roadway connecting the second roadway with the first roadway and allowing a vehicle traveling on the second roadway in the second roadway first direction to continuously travel onto the first roadway in the first roadway first direction; and providing a fourth turn roadway connecting the second roadway with the first roadway and allowing a vehicle traveling on the second roadway in the second roadway second direction to continuously travel onto the first roadway in the first roadway first direction, wherein the second turn roadway and the third turn roadway each at least in part form a first multi-turn ramp that traverses and is provided above the second roadway.

2. The method of claim 1, which further comprises providing at least one of the second or third turn roadways to traverse at least a portion of one of the first or second roadways.

3. The method of claim 1, which further comprises:

providing a fifth turn roadway connecting the first roadway with the second roadway and allowing a vehicle traveling on the first roadway in a first roadway second direction opposite the first roadway first direction to continuously travel onto the second roadway in the second roadway first direction;

providing a sixth turn roadway connecting the first roadway with the second roadway and allowing a vehicle traveling on the first roadway in the first roadway second direction to continuously travel onto the second roadway in the second roadway second direction;

providing a seventh turn roadway connecting the second roadway with the first roadway and allowing a vehicle traveling on the second roadway in the second roadway second direction to continuously travel onto the first roadway in the first roadway second direction; and providing an eighth turn roadway connecting the second roadway with the first roadway and allowing a vehicle traveling on the second roadway in the second roadway first direction to continuously travel onto the first roadway in the first roadway second direction.

4. The method of claim 3, wherein at least one of the fifth and seventh turn roadways at least in part forms a ramp that traverses the second roadway.

5. The method of claim 3, wherein the fifth and seventh turn roadways each at least in part forms a ramp that traverses the second roadway.

6. The method of claim 3, wherein the fifth turn roadway and the seventh turn roadway each at least in part form a second multi-turn ramp, the second multi-turn ramp traverses the second roadway.

7. The method of claim 3, wherein the second roadway comprises multiple travel lanes in each of the second roadway first and second directions.

8. The method of claim 3, wherein the first roadway comprises multiple travel lanes in each of the first roadway first and second directions, and the second roadway comprises multiple travel lanes in each of the second roadway first and second directions.

9. The method of claim 6, further comprising providing a first pylon support to support the first multi-turn ramp transverse the second roadway and a second pylon support to support the second multi-ramp transverse the second roadway.

10. A system for improved vehicular movement between first and second roadways in crossing alignment, the system comprising:

a first roadway provided at a distinct elevation above a second roadway in an area where the roadways cross each other;

a first turn roadway connecting the first roadway with the second roadway and allowing a vehicle traveling on the first roadway in a first roadway first direction to continuously travel onto the second roadway in a second roadway first direction;

a second turn roadway connecting the first roadway with the second roadway and allowing a vehicle traveling on the first roadway in the first roadway first direction to continuously travel onto the second roadway in a second roadway second direction opposite the second roadway first direction;

a third turn roadway connecting the second roadway with the first roadway and allowing a vehicle traveling on the second roadway in the second roadway first direction to continuously travel onto the first roadway in the first roadway first direction; and a fourth turn roadway connecting the second roadway with the first roadway and allowing a vehicle traveling on the second roadway in the second roadway second direction to continuously travel onto the first roadway in the first roadway first direction, wherein the second turn roadways and the third turn roadway each at least in part form a first multi-turn ramp that traverses and is provided above at least a portion of one of the first or second roadways.

11. The system of claim 10, further comprising:

a fifth turn roadway connecting the first roadway with the second roadway and allowing a vehicle traveling on the first roadway in a first roadway second direction opposite the first roadway first direction to continuously travel onto the second roadway in the second roadway first direction;

a sixth turn roadway connecting the first roadway with the second roadway and allowing a vehicle traveling on the first roadway in the first roadway second direction to continuously travel onto the second roadway in the second roadway second direction;

a seventh turn roadway connecting the second roadway with the first roadway and allowing a vehicle traveling on the second roadway in the second roadway second direction to continuously travel onto the first roadway in the first roadway second direction; and an eighth turn roadway connecting the second roadway with the first roadway and allowing a vehicle traveling on the second roadway in the second roadway first direction to continuously travel onto the first roadway in the first roadway second direction.

12. The system of claim 11, wherein at least one of the fifth and seventh turn roadways each at least in part forms a ramp that traverses the second roadway.

13. The system of claim 11, wherein the fifth and seventh turn roadways each at least in part forms a ramp that traverses the second roadway.

14. The system of claim 11, wherein the second roadway comprises multiple travel lanes in each of the second roadway first and second directions.

15. The system of claim 10, wherein the second turn roadway and the third turn roadway each at least in part form a first multi-turn ramp that traverses the second roadway.

16. The system of claim 11, wherein the second turn roadway and the third turn roadway each at least in part form a first multi-turn ramp that traverses the second roadway.

17. The system of claim 16, wherein the fifth turn roadway and the seventh turn roadway each at least in part form a second multi-turn ramp that traverses the second roadway.

18. The system of claim 17, further comprising a first pylon support to support the first multi-turn ramp transverse the second roadway and a second pylon support to support the second multi-ramp transverse the second roadway.

19. The system of claim 11, wherein the first roadway comprises multiple travel lanes in each of the first roadway first and second directions, and the second roadway comprises multiple travel lanes in each of the second roadway first and second directions.

* * * * *

UNITED STATES PATENT AND TRADEMARK OFFICE

CERTIFICATE OF CORRECTION

PATENT NO. : 8,366,342 B2
APPLICATION NO. : 13/548599
DATED : February 5, 2013
INVENTOR(S) : Sutchiewcharn et al.

It is certified that error appears in the above-identified patent and that said Letters Patent is hereby corrected as shown below:

Column 11:
Line 17, after "wherein the second turn", change "roadways" to -- roadway --.

Signed and Sealed this
Nineteenth Day of March, 2013

Teresa Stanek Rea
*Acting Director of the United States Patent and Trademark Office*